United States Patent [19]

Powers

[11] 4,163,634

[45] Aug. 7, 1979

[54] FUEL PUMP PLUNGER

[75] Inventor: Harold C. Powers, Peoria, Ill.

[73] Assignee: Caterpillar Tractor Co., Peoria, Ill.

[21] Appl. No.: 854,851

[22] Filed: Nov. 25, 1977

[51] Int. Cl.[2] ..... F04B 7/04; F02M 59/26

[52] U.S. Cl. ..... 417/499; 123/139 AD

[58] Field of Search ..... 418/499, 500, 494, 493; 123/139 AR, 139 AD, 139 AE, 139 AP

[56] References Cited

U.S. PATENT DOCUMENTS

| | | | |
|---|---|---|---|
| 2,535,535 | 12/1950 | Fleck | 417/494 |
| 2,565,681 | 8/1951 | Fleck et al. | 417/494 |
| 2,638,053 | 5/1953 | Nicolls | 123/139 AE |
| 2,696,786 | 12/1954 | Fleck et al. | 417/499 |
| 2,713,310 | 7/1955 | Muraszew | 417/499 X |

FOREIGN PATENT DOCUMENTS

| | | | |
|---|---|---|---|
| 514011 | 10/1939 | United Kingdom | 123/139 AD |

*Primary Examiner*—Carlton R. Croyle
*Assistant Examiner*—Leonard E. Smith
*Attorney, Agent, or Firm*—Phillips, Moore, Weissenberger, Lempio & Majestic

[57] ABSTRACT

A fuel pump plunger in an injection pump is formed with a shallow groove circumscribed about the periphery between the scroll edge and the pumping end to level off pressure peaks in the injected fuel and to retard timing during deceleration of an engine due to an imposed load.

7 Claims, 9 Drawing Figures

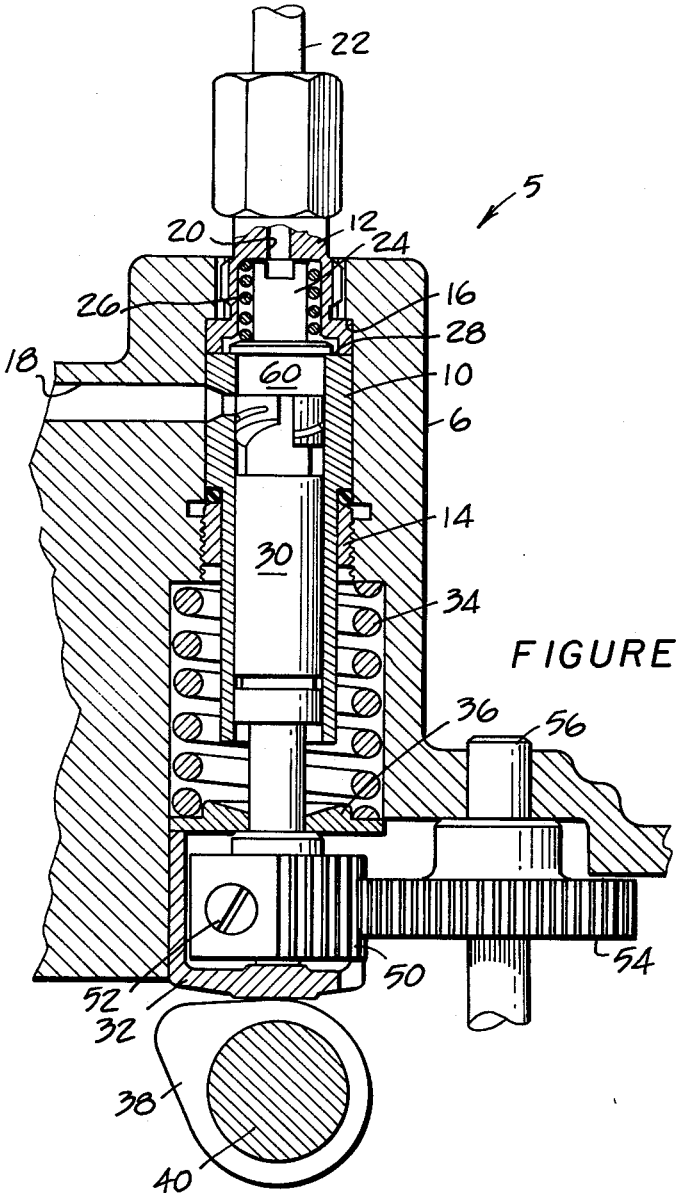
FIGURE 1.
FIGURE 2.
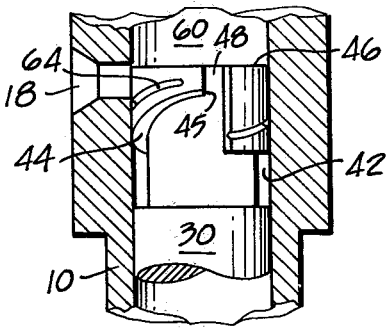
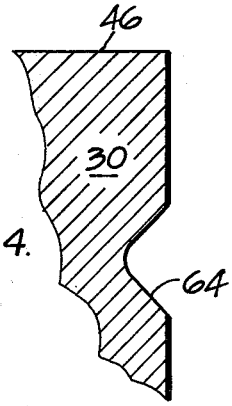
FIGURE 4.
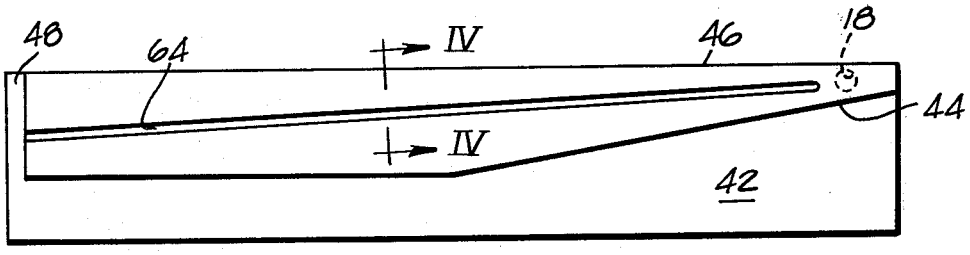
FIGURE 3.

FUEL PUMP PLUNGER

SUMMARY OF THE INVENTION

The present invention relates to fuel injection for internal combustion engines and particularly to a fuel pump plunger.

Internal combustion engines, particularly of the compression ignition type may include the use of a fuel injection pump for each cylinder. These pumps are normally actuated by a drive shaft responsive cam operating a reciprocating plunger which acts on a chamber into which fuel is delivered. The actuation of the plunger by the cam compresses the fuel in the chamber which opens a spring actuated valve at a predetermined pressure to provide a measured amount of fuel to a particular cylinder in the engine. The amount of fuel communicated to the cylinder is normally controlled by a cutaway portion of the plunger, commonly called a scroll edge. This scroll edge tends to relieve pressure in the aforesaid chamber after a predetermined stroke of the plunger. The plunger may be axially rotated in order to control the positioning of the scroll edge relative to the fuel inlet. Such rotation is accomplished by a gear and rack arrangement, commonly referred to as the "rack".

It is well known in the internal combustion engine art that as engine speed increases, timing of the injection of fuel must be advanced in order to obtain efficient operation. However, in order to meet present emission standards, the timing advance of the conventional scroll found in present fuel injection plungers has not proved altogether satisfactory. Furthermore, with an engine set at a relatively high operating speed and thus a fixed position of the rack, an imposition of a load on the engine causes the engine to slow or "lug" with the fuel pump plunger remaining in the pre-set position. As a result, in the conventional fuel pump plunger, timing remains the same and the amount of fuel delivered remains the same, while the engine speed slows. One possible way to solve this problem, and considered in the past, has been to design the plunger with relatively excessive clearance, permitting bleedoff during the plunger stroke. Since the plunger stroke is relatively longer, timewise, during the lug down period the bleedoff is greater and fuel delivery and timing are accordingly reduced and retarded respectively. However, to provide a fuel plunger at the outset with excessive plunger to bore clearance, permits little or no margin for plunger wear.

Accordingly, it is appropriate to provide a fuel pump plunger which increases timing advance as engine speed is increased, and conversely reduces advance with engine lugging under a load. It is further appropriate to provide a fuel pump plunger which reduces the normal torque rise as the engine lugs down from a fixed "rack" or governed speed, that is a fuel pump plunger which tends to reduce fuel delivered per stroke with a reduction in engine speed due to the lugging.

The present invention is directed to overcoming one or more of the problems as set forth above.

Broadly stated, the invention is an improved injection fuel pump plunger in an injection pump which has a cylinder with a fuel inlet. The plunger is reciprocally mounted and axially rotatable in the cylinder from a first angular position to a second angular position. The pump plunger is formed with a circumscribed groove having varying axial width thereabout forming a scroll edge proximate one end of the pump plunger. The scroll edge is at continually increasing distances from the one end of the pump plunger so that the fuel inlet is selectively blocked by the pump plunger for a first length of reciprocal travel of the pump plunger in the cylinder with the pump plunger in the first angular position and a proportionally longer length of reciprocal travel with the pump plunger at angular positions between the first angular position and the second angular position, whereby pressure may be developed in the cylinder at the one end of the pump plunger upon reciprocation thereof. The pump plunger further defines an axial slot communicating with the circumscribed groove and with the one end of the pump plunger. The axial slot is positioned on the periphery of the pump plunger at the point of closest approach of the scroll edge to the one end. The improvement is a relatively shallow bleedoff groove formed in the pump plunger between the scroll edge and the one end. The bleedoff groove selectively communicates the fuel inlet with the circumscribed groove at an angular position of the pump plunger at least greater than the first angular position.

A BRIEF DESCRIPTION OF THE DRAWINGS

FIG. 1 illustrates a vertical sectional view of a fuel pump in which a fuel pump plunger of the structure described herein is utilized.

FIG. 2 is a sectional view of a portion of the fuel pump shown in FIG. 1, showing the details of the fuel pump plunger scroll edge and bleedoff groove of this invention.

FIG. 3 is a developed view of the fuel pump plunger scroll edge and bleedoff groove in accord with this invention.

FIG. 4 is a sectional view of the bleedoff groove shown in the developed view of FIG. 3 at section line IV—IV.

DETAILED DESCRIPTION OF THE PREFERRED EMBODIMENT

Figure 5:
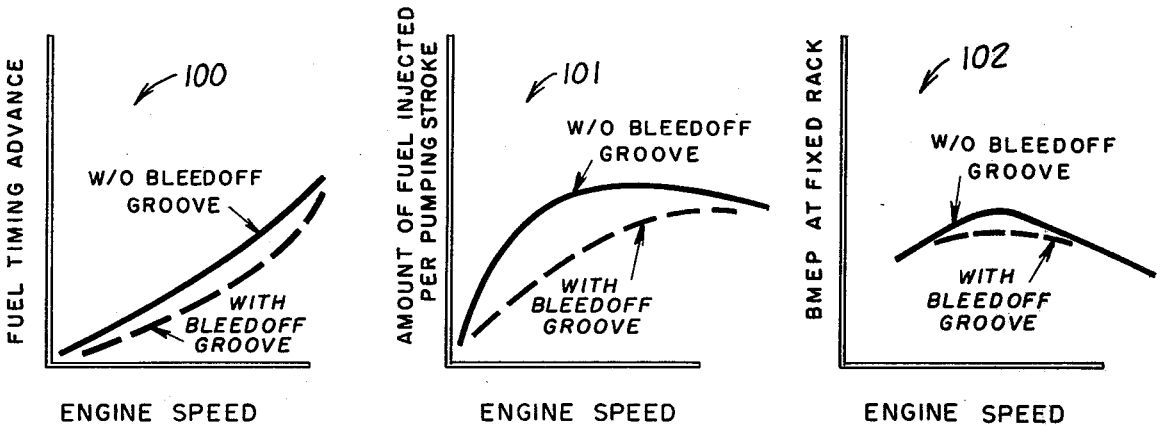
FIG. 5 is a series of graphical representations of engine performance with and without the fuel pump plunger of this invention.

Referring to FIG. 1 a typical fuel injection pump for a compression ignition type engine is illustrated. The pump 5 is comprised of a housing 6 which contains a pump cylinder 10 and a valve housing 12, both of which may be held in housing 6 by an internal nut 14 urging the two against a shoulder 16 formed in the housing. A bore 18 communicates with the pump cylinder and supplies fuel from a source of fuel by means of a transfer pump, neither of which are shown. Fuel is maintained in the bore by the transfer pump at a relatively low pressure.

A discharge port 20 is formed in valve housing 12 to communicate fuel under a high pressure through a fuel line 22 which may be interconnected with an engine cylinder (not shown). Disposed in valve housing 12 is a valve member 24 which is urged downwardly by a resilient member 26 to seat against the upper end 28 of pump cylinder 10. Thus, the valve member acts as a check valve for fuel communicated to pump cylinder chamber 60. Upon pressurization of such fuel by a pump plunger 30 which is disposed in the pump cylinder valve member 24 opens to communicate the high pressure fuel to fuel line 22. Pump plunger 30 extends downwardly to seat in a cam follower cup 32. A resilient member 34 acts on pump plunger 30 by means such as a spring seat 36 abutting the cam follower cup. The resilient member may abut the housing at its other end. A cam 38 is rotatable by a shaft 40 associated with the drive shaft of an internal combustion engine (not shown). Cam 38 acts on cam follower cup 32 to cause pump plunger 30 to move in a reciprocal manner in pump cylinder 10.

Pump plunger 30 has circumscribed about the end proximate bore 18 a groove 42 of varying axial width as indicated in FIG. 2. This circumscribed groove defines a scroll edge 44 at the end proximate bore 18. The scroll edge is at varying distances from end 46 of the plunger.

An axial slot 48 formed in pump plunger 30 communicates cylinder chamber 60 with the circumscribed groove 42 as indicated in FIG. 2. The axial slot is formed on pump plunger 30 adjacent the point 45 of closest approach of the scroll edge 44. Referring to FIG. 3 the scroll edge 44 is shown in a developed view. It can be seen that scroll edge 44 increases its separation from end 46 at least for a portion of the circumference and then remains at a relatively constant distance from end 46, so that rotation of plunger 30 in cylinder 10 will result in varying lengths of time that bore 18 is closed during the reciprocal travel of plunger 30.

Axial rotation of plunger 30 from a first angular position corresponding to an "idle" condition to a second angular position for "full power" condition is accomplished by means of a gear segment 50 affixed to plunger 30 in a manner well known in the art, for example, by a set screw 52 or the like. For convenience, angular positions of the pump plunger between the first angular position and the second angular position are referred to as angular positions "greater than" the first angular position. Intermeshing with gear segment 50 is a spur gear 54 carried on the shaft 56 mounted in housing 6 and rotatable mechanisms well known in the art to control rotation of the plunger and thus the amount of fuel communicated to the individual cylinders of the internal combustion engine.

Angular rotation of pump plunger 30 in the manner just described by gear 54 causes bore 18 to be closed for varying lengths of time relative to the reciprocation of the plunger by cam 38. When scroll edge 44 passes bore 18 in its upward travel, fuel which is under pressure in cylinder chamber 60 is relieved through axial slot 48 back to bore 18.

Under constant speed and load conditions, such an arrangement is adequate, however, with the imposition of loads to the internal combustion engine, the engine slows and thus timing, as previously noted, must be retarded. In order to retard such timing, plunger 30 is formed with a relatively shallow peripheral bleedoff groove 64 between scroll edge 44 and the one end 46 and which in the primary embodiment communicates at one end with axial slot 48. In practice it has been found that this bleedoff groove, in plunger diameters of approximately 0.4" (1.03 centimeters), may have a width of 0.03" (0.08 centimeters) and a depth of 0.02" (0.04 centimeters) with a 60° to 90° V-shape as indicated in FIG. 4. Referring again to FIG. 3, it can be seen that the inlet bore 18 is shown in phantom and in the position the inlet bore would normally be with the accompanying internal combustion engine at an idle speed. Thus the bleedoff groove in the primary embodiment may not be effective at idle speed.

In operation, the plunger 30, as indicated in FIG. 1, is rotated to the desired position through spur gear 54 angularly moving the pump plunger to a position at least greater than the aforedescribed first angular position. As the engine operates, cam 38 reciprocates pump plunger 30 so that fuel communicated to cylinder chamber 60 with the plunger in the full down position is pressurized by the upmoving plunger and ejected through passage 20 to the appropriate cylinder at a predetermined time and pressure. As the peripheral bleedoff groove 64 comes into register with port 18 the relatively shallow dimension of the bleedoff groove causes a relief in pressure, thereby lessening the amount of fuel injected as indicated in graph 101 in FIG. 5. The effect of the bleedoff groove is to slow the timing advance during speed reduction, illustrated in graph 100 in FIG. 5, and thus reduce torque as shown in graph 102.

Figure 6:
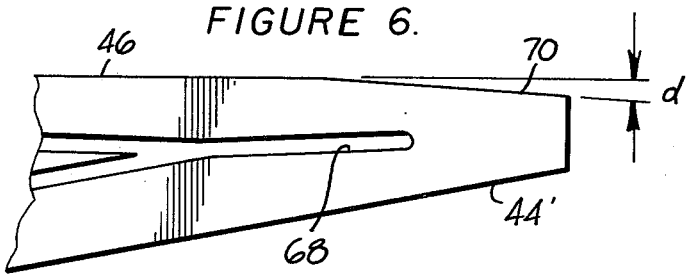
FIG. 6 is an alternate embodiment of the bleedoff groove shown in FIG. 3.

Referring now to FIG. 6, an alternative to the primary embodiment is shown. It can be seen that scroll edge 44' is constructed in the same manner as in the primary embodiment, however, the bleedoff groove 68 is bifurcated at a point proximate the point of closest approach of scroll edge 44', which would result in flatter curves than shown in FIG. 5, due to bleedoff through two paths. Also in FIG. 6, the upper edge 46' may be chamfered as indicated at 70 a predetermined amount "d" in order to retard the timing at the idle position. This chamfered edge 70 is in the manner of the chamfering taught in U.S. Pat. No. 2,535,535 issued to K. J. Fleck on Dec. 26, 1950 and assigned to the assignee of this invention. Operation of the embodiment shown in FIG. 6 is in the manner described above, relating to the primary embodiment.

Figure 8:
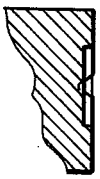
FIG. 8 is a sectional view of the bleedoff groove shown in FIG. 7 and taken at line VII—VII.
Figure 7:
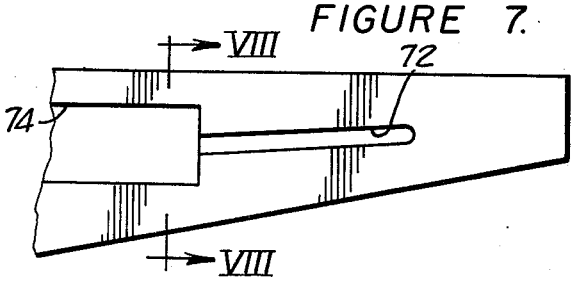
FIG. 7 is a second alternate embodiment of the bleedoff groove shown in FIG. 3.

A third embodiment is depicted in FIGS. 7 and 8 wherein the bleedoff groove 72 is in the manner described in the primary embodiment for a first portion of the perimeter of the plunger, while in the latter or higher torque region the bleedoff groove 74 is formed over a longer axial distance, but with less depth, thus further flattening the curves indicated in FIG. 5. Again operation of the embodiment depicted in FIGS. 7 and 8 is in the manner of the primary embodiment.

Figure 9:
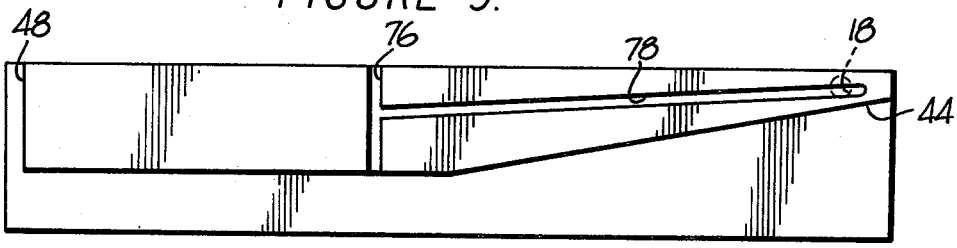
FIG. 9 is still another view of an alternate embodiment of the bleedoff groove shown in FIG. 3.

In FIG. 9, an axial groove 76 is formed of the same dimension generally as the bleedoff groove 78 which has the relative same dimension as groove 64 in the primary embodiment. The axial groove 76 is located somewhere past the position inlet 18 would be with the pump plunger rotated to the maximum power position.

Furthermore in the embodiment depicted in FIG. 9, and also in the other embodiments, the bleedoff groove 78 may extend into the idle position to perform in the manner similar to the notch described in U.S. Pat. No. 2,565,681 issued to K. J. Fleck, et al. on Aug. 28, 1951, also assigned to the assignee of this invention.

The embodiment depicted in FIG. 9 operates generally in the same manner as the primary embodiment, however, the bleedoff through peripheral groove 78 occurs through axial groove 76, rather than through axial groove 48 as indicated in the primary embodiment.

It should be understood that as in the primary embodiment an axial slot 48 also exists in each alternate embodiment depicted to relieve the pressure in chamber 60 when the plunger reaches its upward position in the same manner as in the primary embodiment.

It is important to understand that in each embodiment depicted and described above, the restriction to bleed-off can be controlled at either end of the grooves or further in the embodiment depicted in FIG. 9 can be controlled through the groove 76. It should be understood that the grooves are a restriction in the form of a capillary to bleedoff the higher pressure during the stroke of the pump plunger 30. Furthermore, it should be understood that the structure of the elements of the pump other than the plunger are exemplary and thus not considered limiting.

Although this invention has been described in the context of several embodiments, it is to be understood that the invention is to be limited only as set forth in the appended claims.

The embodiments of the invention in which an exclusive property or privilege is claimed are defined as follows:

1. In an injection pump having a cylinder with a fuel inlet, an injection pump-fuel pump plunger reciprocally mounted and axially rotatable in said cylinder from a first angular position to a second angular position, and said pump plunger having a circumscribed groove of varying axial width thereabout, the groove having a scroll edge proximate one end of said plunger, said scroll edge increasing in distance from its closest point of approach to the one end of said pump plunger for less than the circumference of said plunger and remaining at substantially equal distance from said one end for substantially the rest of the circumference, so that said fuel inlet is selectively blocked by said pump plunger for a first length of reciprocal travel of said pump plunger with said pump plunger at said first angular position and blocked for a proportionally longer length of reciprocal travel of said pump plunger with said pump plunger at angular positions between said first angular position and said second angular position whereby pressure may be developed in said cylinder at said one of said pump plunger upon reciprocation thereof, said pump plunger further defining an axial slot communicating said circumscribed groove with said one end, said axial slot positioned on the periphery of said pump plunger at the point of closest approach of said scroll edge to said one end; the improvement comprising a bleed-off groove formed in said pump plunger and selectively communicating said fuel inlet with said circumscribed groove at angular positions between a position at least greater than said first angular position and a position equal to said second angular position of said pump plunger; said bleed-off groove relatively shallower than said circumscribed groove and positioned between said scroll edge and said one end.

2. The improved fuel pump plunger of claim 1 wherein the pump plunger defines a relatively shallow axial groove communicating the one end with the circumscribed groove, and further wherein the bleedoff groove intersects the relatively shallow axial groove.

3. The improved fuel pump plunger of claim 1 wherein the bleedoff groove intersects the axial slot.

4. The improved fuel pump plunger of claim 3 wherein the bleedoff groove is of V-shaped cross-section.

5. The improved fuel pump plunger of claim 3 wherein the pump plunger defines a second relatively shallow groove intersecting the bleedoff groove at a point proximate the point of closest approach of the scroll edge to the one end.

6. The improved fuel pump plunger of claim 3 wherein the bleedoff groove is relatively flat bottomed.

7. The improved fuel pump plunger of claim 6 wherein the pump plunger further defines a relatively narrower groove extending from one end of the shallow flat bottom groove toward the axial groove.

* * * * *